United States Patent [19]

Holighaus

[11] 4,331,126

[45] May 25, 1982

[54] FURNACE FOR SOLID FUELS

[75] Inventor: Armin Holighaus, Eschenburg-Eiershausen, Fed. Rep. of Germany

[73] Assignee: Gebrüder Weiss K.G., Dillenburg, Fed. Rep. of Germany

[21] Appl. No.: 174,173

[22] Filed: Jul. 31, 1980

[30] Foreign Application Priority Data

Aug. 8, 1979 [DE] Fed. Rep. of Germany ..... 2932224

[51] Int. Cl.[3] ..... F23H 1/02

[52] U.S. Cl. ..... 126/163 R; 126/181; 110/276; 110/288

[58] Field of Search ..... 110/275, 276, 287, 288, 110/300, 165 A, 167, 168, 327; 126/163 R, 181

[56] References Cited

U.S. PATENT DOCUMENTS

| | | | |
|---|---|---|---|
| 1,497,823 | 6/1924 | Worker | 110/165 R |
| 1,595,425 | 8/1926 | Sauvageot | 110/276 |
| 2,051,282 | 8/1936 | Yerges | 110/288 |
| 2,088,023 | 7/1937 | Baer et al. | 110/288 |
| 2,392,189 | 1/1946 | Riddell | 110/288 |
| 4,013,060 | 3/1977 | Martin | 110/276 |

*Primary Examiner*—Henry C. Yuen

*Attorney, Agent, or Firm*—Toren, McGeady and Stanger

[57] ABSTRACT

A solid fuel furnace includes a combustion chamber and an elongated grate trough extending below the combustion chamber for charging the solid fuel into the chamber. A tube extends within the grate trough so that the axis of the tube is parallel to that of the trough, the tube being supported at the ends of the chamber for rotation about the tube axis. Blade members are provided on the outer circumferential surface of the tube to convey the solid fuels introduced into the furnace in the axial direction of the tube as the tube is rotated. The blade members have radially extending openings which communicate with the interior of the tube, and combustion air is supplied to the tube interior at one end of the tube so that the combustion air is introduced into the combustion chamber through the blade members as the tube rotates. Accordingly, both solid fuel and combustion air are charged into the combustion chamber at a desired rate by the rotating tube and blade members. This arrangement has an additional advantage in that the combustion air serves to cool the tube and the blade members thereon during operation of the furnace.

9 Claims, 5 Drawing Figures

FURNACE FOR SOLID FUELS

BACKGROUND OF THE INVENTION

This invention relates to a furnace for solid fuels, in which the fuels are charged into a combustion chamber by at least one conveyor screw. The combustion chamber is charged simultaneously with combustion air by at least one blower.

In furnaces of so-called underfeed construction, solid fuels, particularly combustible wastes such as, for example, garbage, wood shavings, bark shavings and similar shavings are pressed by means of a conveyor screw or a charging piston into an elongated grate trough. Because of a continuous replenishing charge of fuel, the fuel rises through a fire grate arranged above the trough, and is subjected to combustion with an additional supply of atmospheric oxygen. In this case, the combustion air is blown laterally into the furnace through a lower blast or wind box to provide a lower air supply or below-grate blast, and through injection nozzles arranged above the fire grate or the glowing fire to provide an upper air supply.

Furnaces of the above type, usually intended for small capacities, have various deficiencies. For example, the conveyor screw cannot press the fuel material from the trough, through the fire grate and toward the top of the furnace with uniform speed and in a continuous manner as measured over the entire cross-section of the grate trough in the direction of the axis of the conveyor screw. This not only results in a low specific capacity, but also causes inferior or only partial combustion and, thus, low efficiency with a high degree of emissions.

It is an object of the invention to avoid the disadvantages of the prior furnaces and to provide a furnace of simpler construction and with a higher specific capacity, the furnace featuring a more rapid combustion with higher efficiency resulting from use of an air supply which provides an air distribution such as to obtain more intense combustion.

In accordance with the invention, this object is met by arranging the conveyor screw so that it forms a movable fire grate and serves to introduce a portion or all of the combustion air into the combustion chamber of the furnace so as to provide a uniform distribution of the air in the chamber.

The invention replaces the stationary fire grate required in the known underfeed firing constructions by a more advantageous, effectively movable grate in the form of a conveyor screw, or a number of conveyor screws arrranged parallel to one another. As a result, two important functions, namely charging of the fuel and passing it through a fire grate are simultaneously fulfilled. In addition, a third important function is realized. That is, the supply of combustion air, or at least a portion thereof, and its uniform distribution over the entire depth of the combustion chamber, is carried out by the conveyor screw. As already mentioned, this not only intensifies, but also accelerates combustion. Finally, the conveyor screw also serves to remove ash. Accordingly, the furnace according to the invention can be controlled automatically, and in a simple manner. Notably, the enhanced combustion which is now possible significantly reduces the degree of emissions into the exhaust air, without requiring additional filters or similar devices.

In accordance with another aspect of the invention, the conveyor screw or screws extend over the entire depth of the combustion chamber, and the ends of the conveyor screw or screws are supported outside the chamber interior, in or outside of the chamber walls so as to be protected from heat. This simplifies and reduces the cost of the construction of bearings for the conveyor screw and, above all, the service life of the bearings is increased.

In addition to introducing and distributing combustion air through the conveyor screw or screws, the invention contemplates the introduction of additional air for combustion on both sides of and over the length of the grate trough into the combustion chamber. For this purpose, the grate trough is provided, in a known manner, with injection openings for admitting a portion of the combustion air.

This additional injection of combustion air over the length of the grate trough can be used when complete combustion of the fuel material is desired, in spite of an undesirable consistency of the material. However, if only partial combustion is desired in order to produce combustible gases, as in the case of so-called pyrolysis through combustion with a deficiency of the amount of oxygen, the metered supply of combustion air through only the conveyor screw or screws is sufficient.

In accordance with a first embodiment of the invention, a conveyor screw arrangement is constructed with a double wall and consists of a central tube which extends over the depth of the combustion chamber in the direction of the tube axis, and has air transfer openings for passage of the combustion air. At the end of the central tube closer to a combustion air blower, the tube extends through a wind box, and is provided with air inlet windows at this location. The arrangement further includes an outer conveyor tube with a conveyor screw or individually mounted blades for conveying the fuel, the outer conveyor tube being supported coaxially on and fixed for rotation with the central tube at a certain radial distance therefrom. The outer tube has a number of outlet openings, particularly through the blades, for directing air into the combustion chamber. This construction facilitates dynamic cooling, by way of the transferred combustion air, of the outer conveyor tube which is directly exposed to the furnace fire, and provides direct protection of the central tube. Both tubes can be made of suitable materials which are mechanically and thermally compatible with one another. A second embodiment of the invention features a number of individual hubs arranged adjacent one another on the central tube for rotation therewith. The hubs have a U-shaped cross-section and serve as blade carriers. The hubs form individual annular spaces which communicate with the air transfer bores provided in the central tube. Combustion air from these annular spaces is discharged through openings provided in the hubs and/or through nozzles extending radially in the blades.

In a variation of the second embodiment, each hub has two diametrically oppositely located blades, and the air transfer bores provided in the central tube are arranged diametrically opposite each other and angularly offset by 90° relative to the two blades of each hub. In this case, an axialy extending drive spline is fastened on the outer circumference of the central tube, and axially extending grooves are provided on the inner circumferences of any two adjacent hubs so that their blades are angularly offset by 90° relative to one another, the grooves engaging the drive spline on the central tube.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there are illustrated and described preferred embodiments of the invention.

DETAILED DESCRIPTION OF THE INVENTION

Figure 1:
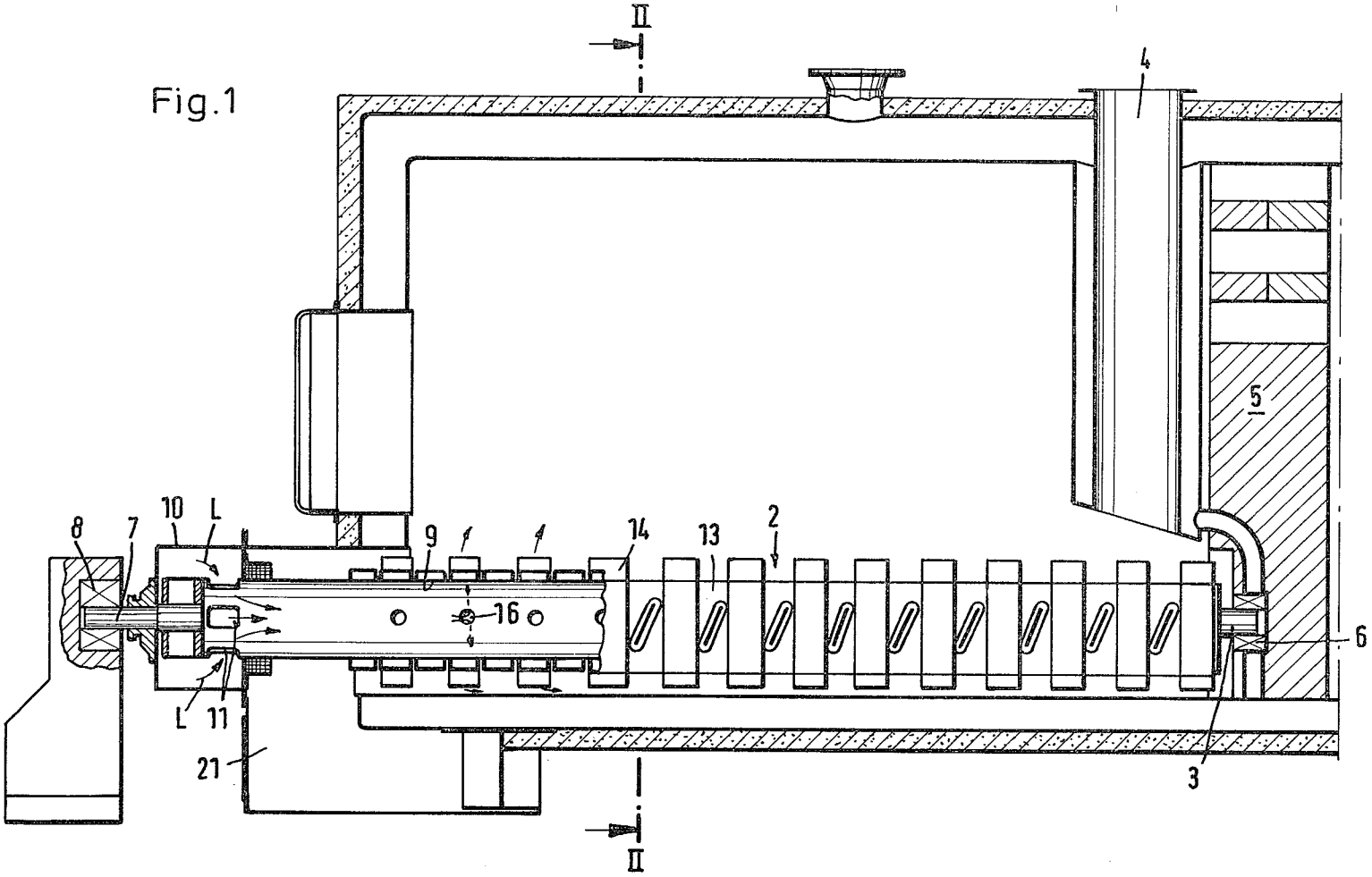
FIG. 1 is a partially sectional view of a portion of a furnace according to the present invention.
Figure 2:
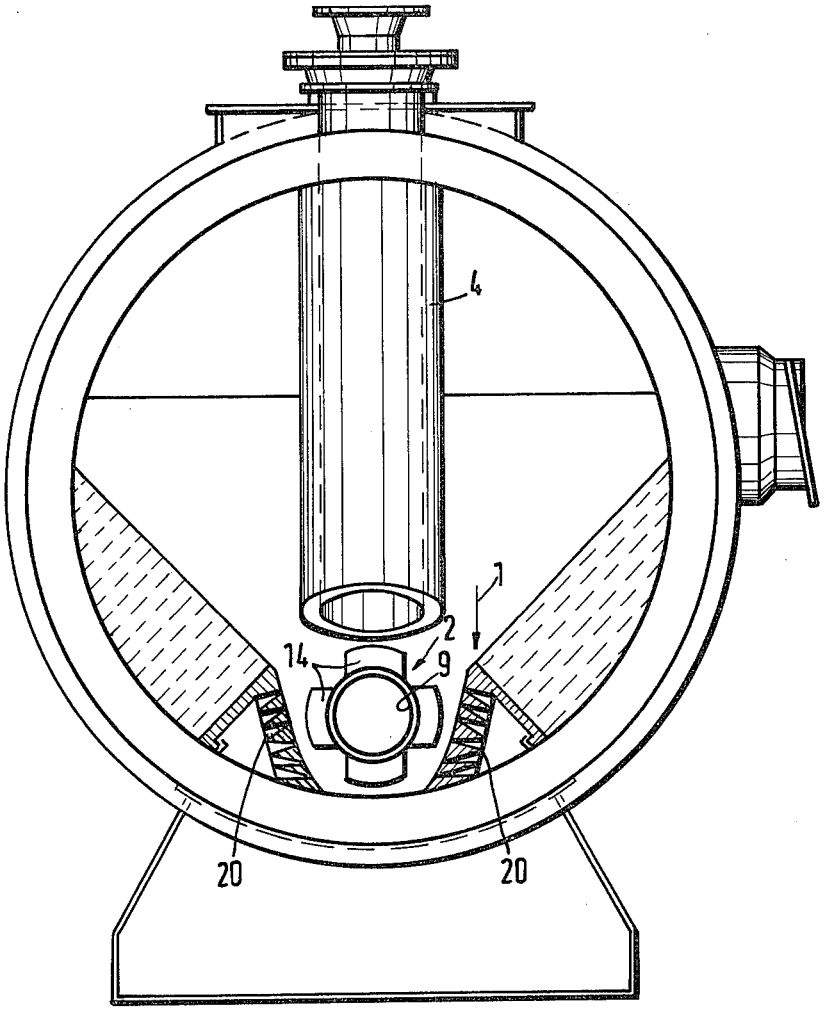
FIG. 2 is a sectional view taken along the line II—II in FIG. 1.

As shown in FIGS. 1 and 2, a conveyor screw arrangement 2 extends within an elongated grate trough 1 of a furnace. One end 3 of the conveyor screw arrangement is supported for rotation in a bearing 6. The bearing 6 is mounted in a water-cooled intermediate wall 5 in the region of a fuel charging device 4 where the yield of heat is lower. The other end 7 of the conveyor screw arrangement 2 is supported for rotation in a bearing 8. Rotational motion generated by a control drive mechanism (not shown) is imparted to the conveyor screw arrangement at its end 7.

The conveyor screw arrangement 2 includes a central tube 9 which, at its end closer to the bearing 8, extends through a blower wind box 10. At this location, the tube 9 is provided with four air inlet windows 11 for combustion air L which is delivered by a blower (not shown), the windows 11 extending through the wall of the tube 9 and spaced apart from one another in the circumferential direction of the tube 9.

Figure 4:
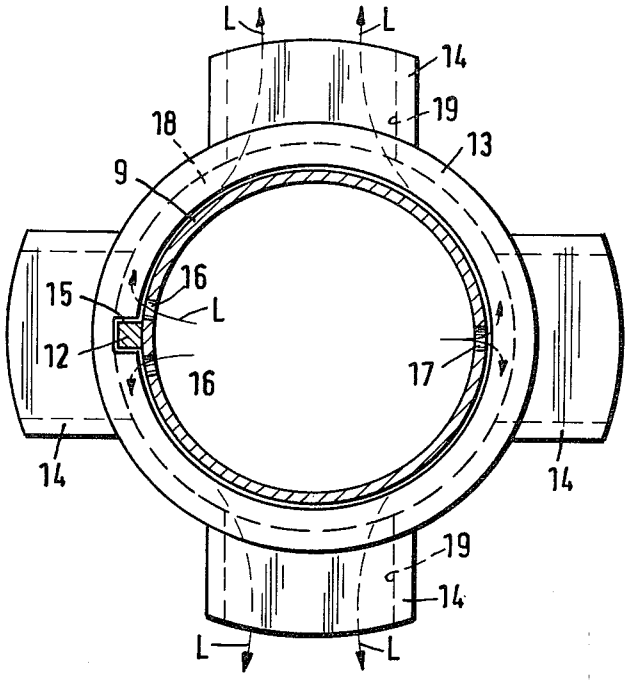
FIG. 4 is a sectional view taken along line IV—IV in FIG. 3.
Figure 3:
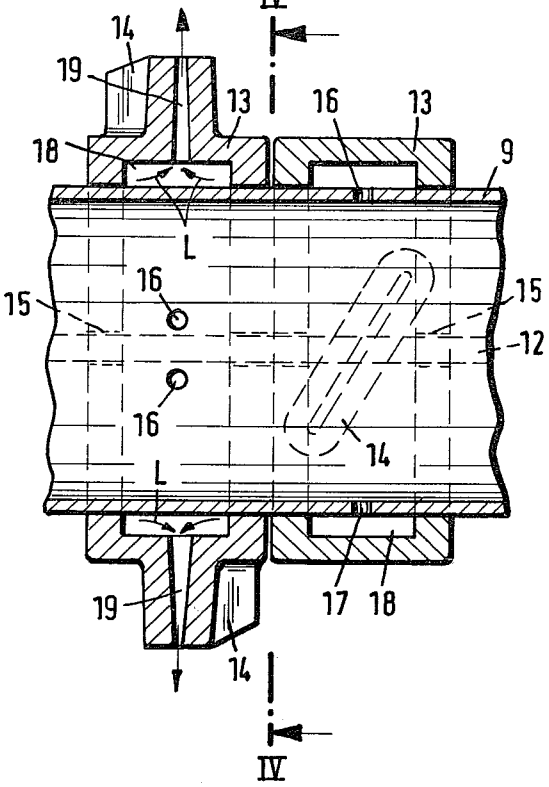
FIG. 3 is an enlarged longitudinal sectional view of a conveyor screw arrangement in the furnace of FIG. 1.

As FIGS. 3 and 4 show more clearly, a drive spline 12 is fitted on the outer surface and extends parallel to the axis of the central tube 9. The drive spline 12 engages grooves 15 in a number of individual hubs 13 arranged coaxially on the central tube 9, each hub 13 having a U-shaped cross-section in a plane which extends radially from the tube axis (FIG. 3). The hubs 13 each carry a set of two diametrically oppositely arranged blades 14 which are staggered relative to each other by 90° in relation to any two adjacent hubs 13. The grooves 15, which extend axially along the inner circumferences of each of the hubs 13, are located so that the blades are offset relative to each other by 90° in relation to any two adjacent hubs 13.

The combustion air L is generated by a controllable blower and flows through the windows 11 into the central tube 9. The air L is then distributed, by air transfer bores 16 and 17, into an annular space 18 formed in each of the individual hubs 13. For alternate hubs 13 along the tube 9, it may be necessary to avoid interruption by the drive spline 12 of air flow in the annular space 18. A pair of bores 16 can be provided as shown in FIGS. 3 and 4, each bore 16 opening closely adjacent a different side of the drive spline 12 so that the combustion air L can freely pass to both blades 14 of these hubs.

The air transfer bores 16 and 17 are arranged diametrically opposite each other, but angularly offset by 90° relative to the blades 14, so that each flow of combustion air travels a distance along an arc of 90° within the annular space 18 along the outer periphery of the central tube 9. The combustion air L is discharged to the combustion chamber through radial nozzles 19 formed in the blades 14.

Accordingly, the combustion air L supplied through the central tube 9 simultaneously serves to cool the conveyor screw arrangement 2.

However, combustion air can also be introduced into the combustion chamber of the furnace through bores 20 of various sizes in the grate trough 1, so that an adjustment of the combustion air to different "combustion zones" can be effected. In this case, an arrangement is made so that more air is supplied at the fuel inlet where so-called degasification of fuel takes place very rapidly. Less air is then supplied at the discharge side where only the residues of the fuel are to be burned.

The stoking effect of the above-described conveyor screw arrangement is excellent. This is very important for the combustion of low-grade fuels and fuels which are high in inerts such as, for example, lignite or soft coal. Finally, the screw arrangement serves also for the mechanical removal of ash. An ash removal chute 21 can be provided, for example, at the end of the screw arrangement opposite the fuel charging device 4.

Figure 5:
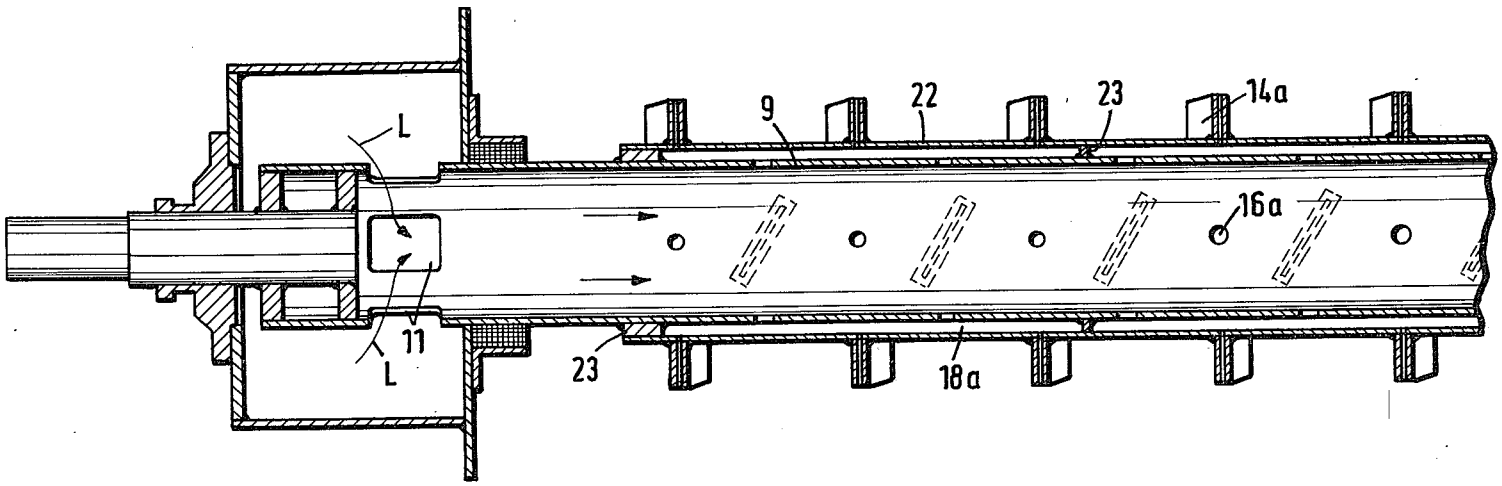
FIG. 5 is an enlarged sectional view of part of another embodiment of a conveyor screw for the furnace of FIG. 1.

FIG. 5 shows another embodiment of a conveyor screw arrangement according to the present invention. This embodiment differs from that of FIGS. 1–4 in that, in place of individual hubs for carrying the conveyor blades, an outer conveyor tube 22 is supported coaxially on the central tube 9, and is fixed at a number of locations 23 to the outer circumference of the tube 9 for rotation therewith. A number of blades 14*a* extend radially from the outer circumference of the outer tube 22, the blades 14*a* being positioned relative to one another with the same angular relationships as the blades 14 in the embodiment of FIGS. 1–4. Air outlet openings are formed through the blades 14*a* for directing air into the combustion chamber of the furnace, this combustion air being supplied through openings 16*a* in the central tube 9 and filling an annular space 18*a* formed between the outer tube 22 and the central tube 9 to be directed into the combustion chamber through the outlet openings in the blades 14*a*.

Accordingly, the construction of FIG. 5 provides dynamic cooling of the outer conveyor tube 22 by the combustion air circulating within the tube 22, and provides protection of the central tube 9 which extends coaxially within the outer tube 22.

While specific embodiments of the invention have been shown and described in detail to illustrate the application of the inventive principles, it will be understood that the invention may be embodied otherwise without departing from such principles.

What is claimed is:

1. A furnace for solid fuels, comprising a furnace housing including a number of walls for forming a combustion chamber within said housing, means within said housing for forming an elongated grate trough which extends below said combustion chamber for charging solid fuel into said combustion chamber, blower means for providing combustion air, a tube extending within said grate trough so that the axis of said tube is parallel to the longitudinal axis of said grate trough, means for supporting said tube for rotation about its axis, blade means including a number of blade members arranged to extend radially outwardly relative to the outer circumferential surface of said tube to rotate together with said tube for conveying the solid fuel in the direction of the axis of said tube when said tube is rotated, said blade members having radially extending nozzle openings for distributing the combustion air into said combustion chamber, and air directing means arranged to communicate the combustion air from said blower means to said nozzle openings in said blade members as said tube rotates so that the fuel and the combustion air are simultaneously charged into said combustion chamber at a desired rate.

2. A furnace according to claim 1, wherein said tube extends between two of said walls which form said combustion chamber, and said means for supporting said tube for rotation is located outside of said combustion chamber to be protected from heat developed inside said combustion chamber.

3. A furnace according to claim 1, wherein said grate trough has a number of air inlet openings therein for providing a combustion air supply in the vicinity of said tube.

4. A furnace according to claim 1, including means at one end of said tube for discharging ash conveyed by said blade means.

5. A furnace for solid fuels according to claim 1, said blower means including a wind box, said tube forming a central tube which extends between two of said walls which form said combustion chamber, said central tube having sets of axially spaced air transfer openings through its wall for passing the combustion air, said central tube extending through said wind box and having at least one air inlet window through its wall within said windbox for admitting combustion air from said blower means into the interior of said central tube, an outer tube coaxially surrounding said central tube and fixed to said central tube for rotation therewith, said outer tube and said central tube forming an annular space between one another, said blade members being arranged on the outer circumferential surface of said outer tube said air directing means being arranged to communicate the combustion air from said blower means through the interior of said central tube and said annular space to said nozzle openings in said blade members.

6. A furnace according to claim 1, wherein said blade means includes a number of hubs each coaxially supported on said tube along the axial direction of said tube, each hub has a generally U-shaped cross-section in a plane extending radially from the tube axis to form an annular space between said hub and said tube, and at least one of said blade members extends radially from each of said hubs, said tube has a number of air outlet openings through its walls to allow combustion air in the interior of said tube to pass into said annular space, and said hubs have openings therein communicating with said annular space to form a part of said air directing means.

7. A furnace according to claim 6, wherein each said hub has two diametrically oppositely located blade members, and said air outlet openings in said tube are arranged diametrically opposite to one another and angularly offset by 90° in relation to the two blade members of an associated hub.

8. A furnace according to claim 6, wherein each said hub has two diametrically oppositely located blade members, and an axially extending groove in the inner circumferential surface of each said hub, and including an axially extending spline on the outer circumferential surface of said tube for engaging each of said grooves in said hubs, the grooves of any two adjacent hubs on said tube being arranged in said hubs so that the blade members of said two adjacent hubs are angularly offset relative to one another by 90°.

9. A furnace according to claims 1 or 5, including fuel inlet means at one end of said grate trough for providing solid fuel to be charged into said combustion chamber, and ash removal means at the other end of said grate trough for discharging ash from said grate trough, and a number of openings in said grate trough for admitting combustion air into said combustion chamber, the cross-sections of said openings in said grate trough decreasing in the direction from said fuel inlet means towards said ash removal means.

* * * * *